US007108577B2

(12) United States Patent
Peters et al.

(10) Patent No.: US 7,108,577 B2
(45) Date of Patent: Sep. 19, 2006

(54) WEDGE-LOCK BUILDING BLOCKS

(76) Inventors: Andrew J. Peters, 240 Serenity Dr., Norwich, NY (US) 13815; Donald F. Peters, 33 Kingsboro Ave., Gloversville, NY (US) 12078

( * ) Notice: Subject to any disclaimer, the term of this patent is extended or adjusted under 35 U.S.C. 154(b) by 0 days.

(21) Appl. No.: 10/329,108

(22) Filed: Dec. 24, 2002

(65) Prior Publication Data

US 2004/0118056 A1 Jun. 24, 2004

(51) Int. Cl.
*A63H 33/08* (2006.01)
*E04B 2/08* (2006.01)

(52) U.S. Cl. ..... 446/124; 446/125; 52/592.6

(58) Field of Classification Search ..... 52/592.6, 52/604, 605, 745.05, 745.13, 747.1, 284, 52/592.5; 446/124, 125, 127, 117, 108, 114, 446/115, 116; D25/113; 285/331; 403/381, 403/292, 359.2, 359.6, 13, 314.5, 409.1; 404/6, 9; 405/286, 284, 287, 273
See application file for complete search history.

(56) References Cited

U.S. PATENT DOCUMENTS

| | | | | | |
|---|---|---|---|---|---|
| D30,707 | S | * | 5/1899 | Paquette | D25/113 |
| 764,459 | A | | 7/1904 | Hackman | |
| 1,171,191 | A | | 2/1916 | Gronert et al. | |
| 1,337,171 | A | | 4/1920 | Ward | |
| 1,779,805 | A | * | 10/1930 | Dunwoodie | 403/359.6 |
| 2,160,158 | A | * | 5/1939 | Lind | 175/417 |
| 2,258,066 | A | * | 10/1941 | Oyen | 285/328 |
| 2,374,284 | A | * | 4/1945 | Hall | 219/120 |
| 2,655,032 | A | | 10/1953 | Zagray | 72/41 |
| 2,814,159 | A | * | 11/1957 | Green | 446/125 |
| 2,902,733 | A | * | 9/1959 | Justus | 52/284 |
| 2,932,745 | A | | 4/1960 | Alberti et al. | 250/108 |
| 3,138,898 | A | | 6/1964 | Carter | 50/347 |
| 3,381,428 | A | | 5/1968 | Sillman | 52/233 |
| 3,439,941 | A | * | 4/1969 | Nicol | 285/21.1 |
| 3,527,004 | A | | 9/1970 | Sorensen | 52/98 |
| 3,529,389 | A | * | 9/1970 | Wilkins | 174/48 |
| 3,534,518 | A | * | 10/1970 | Zagray | 52/258 |
| 4,060,952 | A | | 12/1977 | Hernandez | 52/593 |
| 4,219,225 | A | * | 8/1980 | Sigmund | 285/47 |
| 4,272,940 | A | | 6/1981 | Nicolls | 52/592 |
| 4,299,069 | A | * | 11/1981 | Neumann | 52/309.4 |
| 4,314,431 | A | * | 2/1982 | Rabassa | 52/259 |
| 4,570,799 | A | | 2/1986 | Mednis | 206/509 |
| 4,907,383 | A | | 3/1990 | Winter, IV | 52/86 |
| 4,990,116 | A | * | 2/1991 | Chen | 446/124 |
| 5,213,437 | A | * | 5/1993 | Sommer | 403/359.6 |

(Continued)

*Primary Examiner*—Peter M. Cuomo
*Assistant Examiner*—Sarah B. McPartlin
(74) *Attorney, Agent, or Firm*—Heslin Rothenberg Farley & Mesiti P.C.; Lee Palmateer

(57) ABSTRACT

A building block that is releasably attachable to another block of compatible design by wedging the tongue of one block into the groove of another block, without the need for any intermediate adhesives, bonding materials or any other means of holding the blocks together. The block includes a body, an outwardly-extending tapered tongue, and two inner surfaces that form a tapered groove therebetween. The tongue and groove have substantially the same taper. The top of the tongue is wider than the bottom of the groove. The base of the tongue is wider than the opening of the groove. A tongue and groove joint is also disclosed as well as methods for forming a tongue and groove joint. A base which includes a plurality of spaced-apart tongues and grooves is provided for use in supporting a plurality of building blocks thereon.

26 Claims, 15 Drawing Sheets

U.S. PATENT DOCUMENTS 5,226,276 A * 7/1993 Cahill ..... 52/592.6
5,647,185 A * 7/1997 Forlini ..... 52/604
5,901,520 A * 5/1999 Abdul-Baki ..... 52/592.6
5,966,896 A * 10/1999 Tylman ..... 52/793.1
6,071,041 A * 6/2000 Knight ..... 405/16
6,086,444 A 7/2000 Glickman ..... 446/124
6,122,881 A 9/2000 Aubertot ..... 52/604
6,312,305 B1 11/2001 McCormick et al. ..... 446/85
6,450,543 B1 * 9/2002 Fukano et al. ..... 285/21.1
6,457,911 B1 * 10/2002 Scales et al. ..... 405/262
6,584,740 B1 * 7/2003 Record ..... 52/270
6,641,452 B1 * 11/2003 Racine ..... 446/122
2002/0021042 A1 2/2002 Damron ..... 299/12

* cited by examiner

WEDGE-LOCK BUILDING BLOCKS

TECHNICAL FIELD

The present invention relates to building blocks, and more particularly, to releasably attachable building blocks.

BACKGROUND OF THE INVENTION

A popular type of toy building block is one that has flat surfaces, such as a cube, which can be stacked upon other blocks of like design. Structures made with this type of block are very unstable and can be toppled with the slightest of disturbances. These blocks must also be carefully balanced upon one another, thus limiting the manner in which they can be stacked.

Another popular type of toy building block are LINCOLN LOG building blocks which have transverse notches. The logs are stacked by engaging the notched sections of adjacent logs. These types of blocks can be stacked in only a very limited set of alignments.

Another popular type of toy building block are LEGO building blocks which have a pattern of projections on the top, and recesses on the bottom for engaging the projections. These types of blocks are stacked upon one another by pressing the projections of one block into the recesses of another. These blocks can be stacked together in a limited number of predetermined locations dictated by the pattern of projections and recesses.

There is a need for further building blocks that can be securely and releasably attached together for building relatively stable structures.

SUMMARY OF THE INVENTION

In a first aspect, the present invention provides a building block that includes a body, an outwardly-extending tapered tongue, and a tapered first groove. The taper of the tongue and the taper of the first groove are substantially the same. The opening of the first groove is wider than a distal portion of the tongue. The distal portion of the tongue is wider than a bottom portion of the first groove. The proximal portion of the tongue is wider than the opening of the tapered first groove.

In a second aspect, the present invention provides a building block that includes a body, an outwardly-extending tapered tongue, and a tapered first groove. The taper of the tongue and the taper of the first groove are substantially the same. The block is releasably attachable to another block of the same design by wedging the tongue of the first block into the first groove of the second block.

In a third aspect, the present invention provides a base for use in supporting a plurality of building blocks. The base includes a plurality of spaced-apart upwardly extending tongues and a plurality of spaced-apart grooves. The base may be a foundation upon which tongue and groove building blocks can be assembled by inserting the tongues of the building blocks into the grooves of the base and fitting the grooves of the building blocks over the tongues of said base.

In a fourth aspect, the present invention provides a tongue and groove joint. The joint comprises a tapered tongue of a first member wedged into a tapered groove of another member. The taper of the tongue and the taper of the groove are substantially the same. The opening of the groove is wider than a distal portion of the tongue. The distal portion of the tongue is wider than the bottom portion of the groove. The proximal portion of the tongue is wider than the opening of the groove.

In a fifth aspect, the present invention provides a tongue and groove joint including a first member having a body and a tapered tongue outwardly extending therefrom, and a second member having a body with a tapered groove therein. The tongue of the first member is wedged into the groove of the second member. When the tongue is wedged into the groove, the top of the tongue and the bottom surface of the groove form a gap therebetween, and the body of the first member and the body of the second member form a gap therebetween.

In a sixth aspect, the present invention provides a method of forming a tongue and groove joint by providing a first member having a tapered groove, providing a second member having a tapered tongue, and inserting the tapered tongue into the tapered groove. The taper of the tongue and the taper of the groove are substantially the same. The opening of the groove is wider than a distal portion of the tongue. The distal portion of the tongue is wider than a bottom portion of the groove. The proximal portion of the tongue is wider than the opening of the groove.

In a seventh aspect, the present invention provides a building block that includes a body and a tapered tongue that extends outwardly from and around the body.

In an eighth aspect, the present invention provides a building block that includes a body having a tapered groove that extends around the body.

In a ninth aspect, the present invention provides a building block kit including a first building block that has a body with a tapered tongue outwardly extending therefrom, and a second building block that has a body with a tapered groove therein. The first and second building blocks are releasably attachable together upon wedging the tongue of the first building block into the groove of the second building block.

Other aspects of the present invention include other building block kits that include the above mentioned blocks and base.

These, and other features and advantages of this invention will become apparent from the following detailed description of the various aspects of the invention taken in conjunction with the accompanying drawings.

BRIEF DESCRIPTION OF THE DRAWINGS

The subject matter which is regarded as the invention is particularly pointed out and distinctly claimed in the concluding portion of the specification. The invention, however, may be best understood by reference to the following detailed description of various embodiments and the accompanying drawings in which:

DETAILED DESCRIPTION OF THE INVENTION

Figure 9:
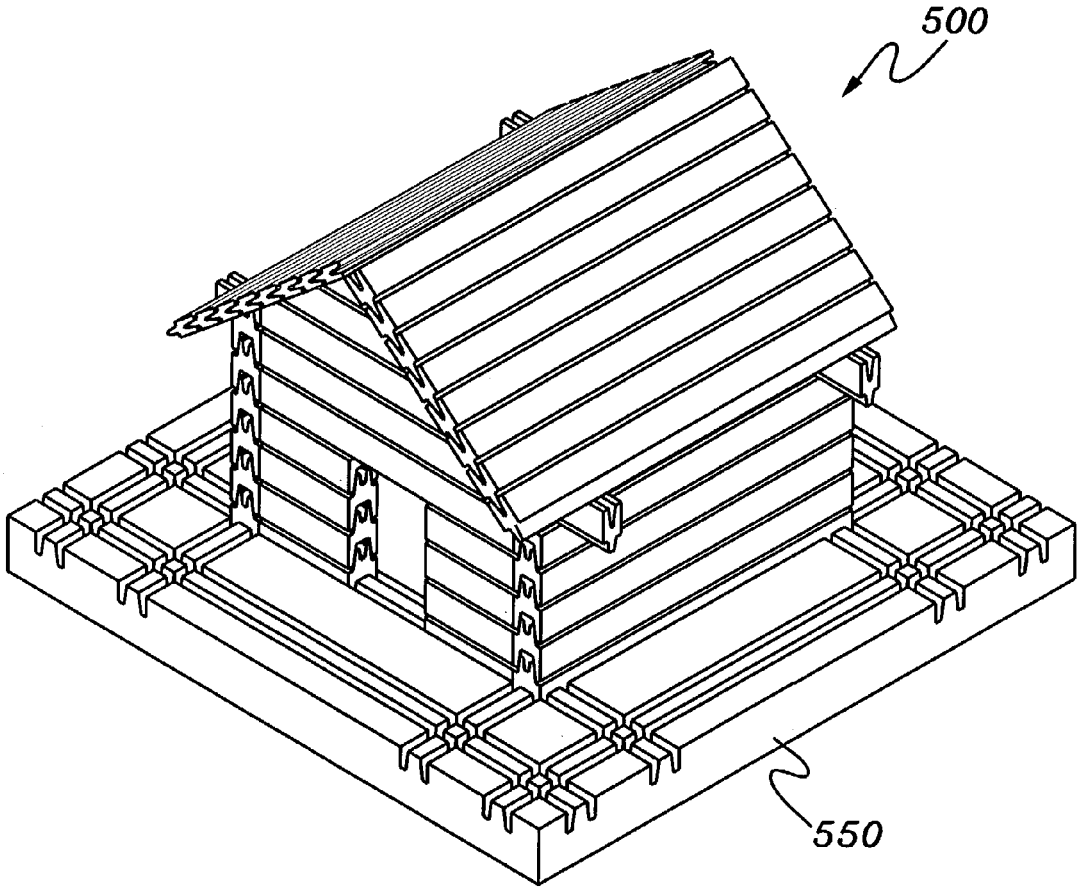
FIG. 9 is an isometric view of a structure formed from the building blocks and a base in accordance with the present invention.

FIGS. 1 through 4 show two different embodiments of the building blocks of the present invention. The blocks are tongue and groove blocks that are releasably attachable together by pressing the tongue of one block into a groove of another block as illustrated in FIGS. 5, 6A, 6B and 7. Structures can be made by releasably attaching a plurality of building blocks as shown in FIG. 9. The attached blocks can be readily detached from each other simply by pulling the blocks apart from each other. The same blocks can be attached and detached repeatedly.

The specific tongue and groove design of the present invention, of which adjacent blocks are releasably attachable, overcomes some of the limitations of currently available building blocks. For example, the present invention provides adjacent blocks that can be assembled in freely variable positions along the tongue and groove longitudinal axes, instead of at a limited number of predetermined positions. This added degree of freedom, combined with the stability of the tongue and groove joint, provides advantages, including, for example, enhanced enjoyment for children playing with toy building blocks of the present invention and the ability of children to make more creative structures than they can with currently available toy building blocks. The stability of structures made using the toy building blocks of the present invention will reduce a child's frustration that can be caused by some conventional building blocks which can be toppled with the slightest of disturbances.

The toy building blocks of the present invention can be suitably sized for handling by children. For example, a toy building block may be about 1–2 inches high and about 1–2 inches wide. A typical child will be capable of easily applying the forces required to assemble and disassemble the toy building blocks of the present invention.

The building blocks of the present invention do not require an adhesive or other intermediate bonding material, such as mortar for a typical concrete building block, to form the joint between and attach adjacent blocks.

The building blocks of the present invention may be made of wood, plastic, or any other suitable material.

With reference again to FIGS. 1 and 2, therein illustrated is a building block 10 in accordance with the present invention. The block includes a body 12, a tapered tongue 14 having two sides 26, and two inner surfaces 20 forming a tapered groove 18 therebetween. The groove may also be formed by two outwardly-extending legs. The tongue has a distal portion 15*a*, a proximal portion 15*b* and may have a top surface 22. The inner surfaces each have a proximal portion 17*a* and a distal portion 17*b*. The groove has a bottom portion 19*a* defined by proximal portion 17*a* of each inner surface 20, and an opening 19*b* defined by distal portion 17*b* of each inner surface. The body may have surfaces 24 adjacent to the distal portion of each inner surface. Bottom portion 19*a* of groove 18 may have a bottom defined by a bottom surface 28. Tongue 14 and groove 18 may run a length L of the block. The body of the block may also include shoulders 30 adjacent to the proximal portion of the tongue.

Figure 2:
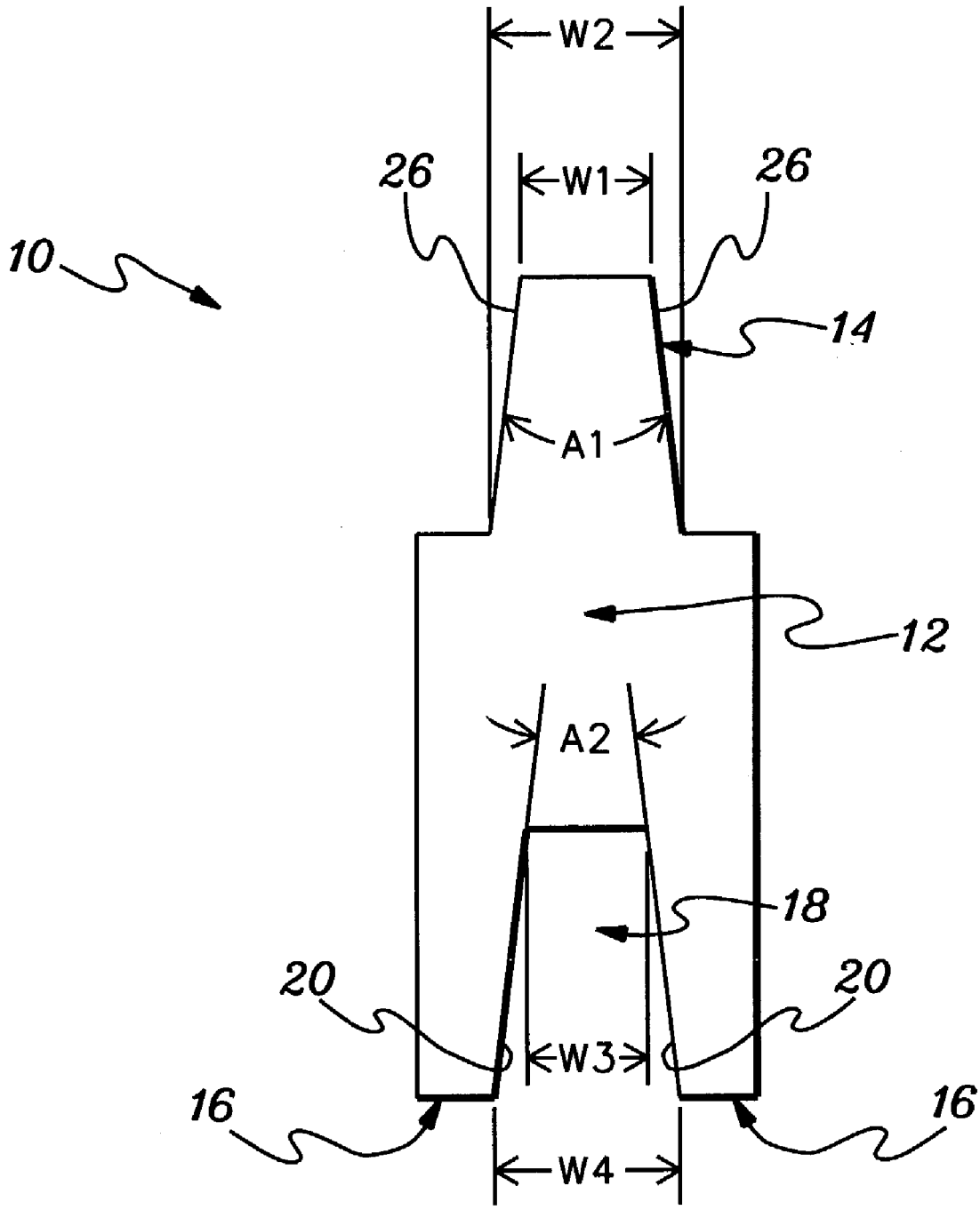
FIG. 2 is an end view of the block of FIG. 1.

With reference to FIG. 2, sides 26 of tongue 14 are shown to converge toward each other at an angle A1. Inner surfaces 20, which define groove 18, are shown to converge toward each other at an angle A2. A1 and A2 may be substantially the same, so that the tongue and groove are similarly tapered. The angles of convergence (or angle of taper) A1 and A2 may be about 14 degrees. Although the tongue is shown to be tapered symmetrically, with both sides 26 inclined at the same angel, for example 7 degrees relative to a common plane, it is understood that the tongue may be tapered asymmetrically with sides 26 each having a different angle of inclination relative to the common plane. Although the groove is shown to be tapered symmetrically with both sides 20 inclined at the same angel, for example 7 degrees relative to a common plane, it is understood that the groove may be tapered asymmetrically with sides 20 each having a different angle of inclination relative to the common plane. The angles of inclination of the sides of the tongue may suitably correspond with the angles of inclination of the sides of the groove for forming a secure and releasably attachable tongue and groove joint.

With further reference to FIG. 2, tongue 14 has a distal portion with, for example a width W1, and a proximal portion with, for example a width W2, wherein W2 is greater than W1. The groove has a bottom portion with, for example a width W3, and an opening with, for example a width W4, wherein W4 is greater than W3. Groove opening width W4 is wider than a distal portion width W1 of the tongue. Distal portion width W1 of the tongue is wider than a bottom portion width W3 of the groove. Proximal portion width W2 of the tongue is wider than opening width W4 of the groove.

Figure 5:
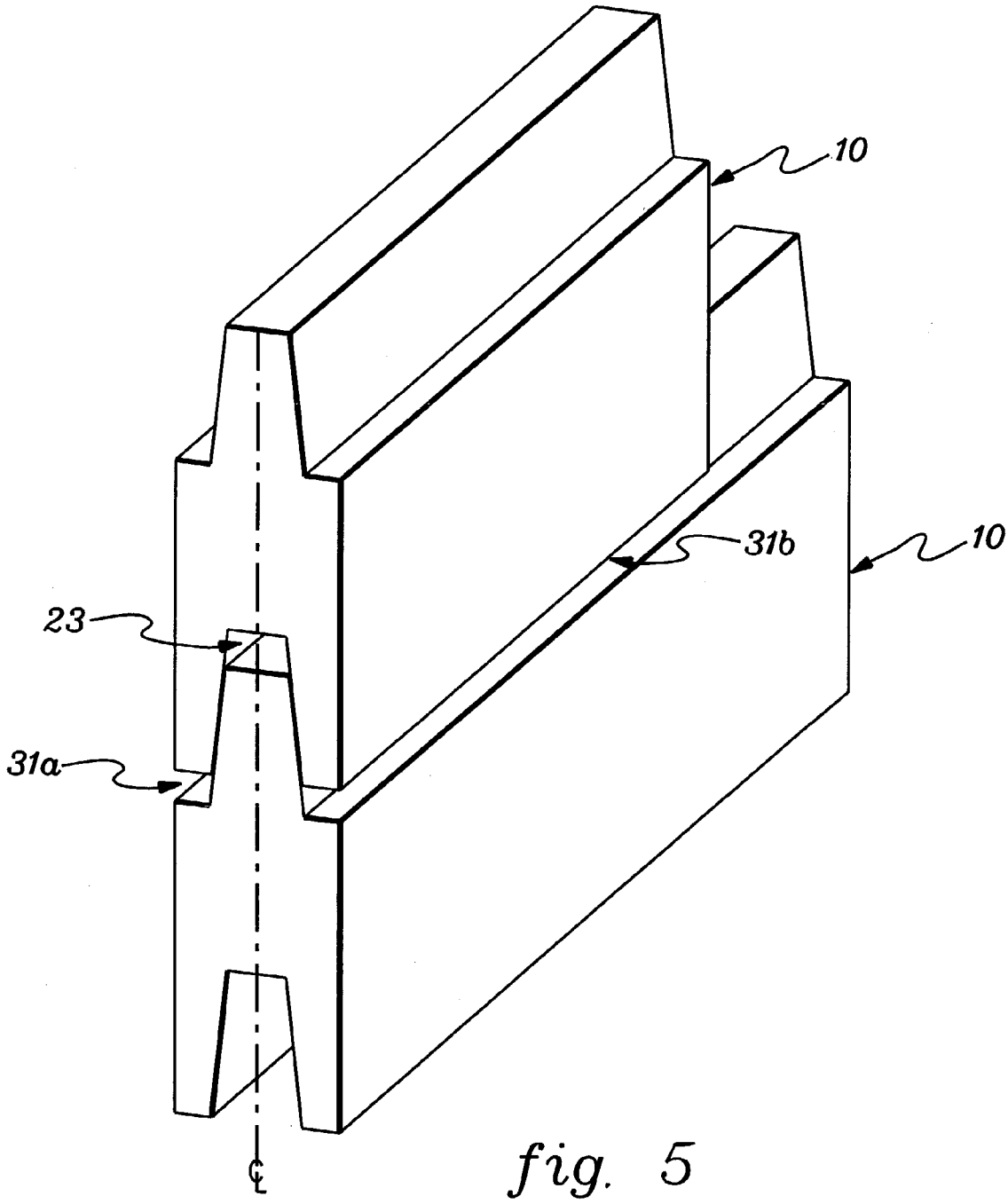
FIG. 5 is an isometric view of two blocks of FIG. 1 joined together.

When a first block 10 and a second block 10 are assembled by inserting the tongue of the first block into the first groove of the second block, as depicted in FIG. 5, contact occurs between the sides of the tongue of the first block and the inner surfaces of the second block. The body of the first block and the body of the second block may form gaps 31*a* and 31*b* therebetween. The tongue and a bottom of the groove may form a gap 23 therebetween. When a tongue of one block is pressed into the groove of another block, a tongue and groove joint will form between the two blocks and releasably attach the blocks together. The blocks will be held together by the forces between the sides of the tongue and the inner surfaces forming the sides of the groove.

After two blocks which are to be releasably attached have made initial contact between the sides of the tongue and groove, the gaps provide clearance to facilitate further movement of the blocks toward each other when they are further pressed together to form the tongue and groove joint.

As the blocks move slightly together, the tongue wedges into the groove, causing compressive forces and resultant friction forces at the tongue and groove interface which hold the adjacent blocks together.

The gaps can be made large enough to ensure that, during any anticipated normal use or wedging together of adjacent blocks, there would be no seating contact between the opposite surfaces that form the gaps, for example: between the top of a tongue and the bottom of a first groove; or between the surfaces of the body of the first block and the body of the second block. The gaps can also be made small enough so that the blocks make seating contact between these surfaces upon the application of suitable pressing forces. Such seating contact would limit further relative movement of the blocks toward each other, and thus limit the forces between the sides of the tongue and groove.

The gaps can be sized differently to achieve seating at desired surfaces. In addition or in the alternative, separate or integral spacers could be used to achieve localized seating. These options, alone or in combination, can be used to achieve various desired effects, for example limiting stresses between the sides of a tongue and sides of a groove while at the same time providing gaps. Gaps may be desirable for many purposes, such as aesthetic purposes or for receiving mortar.

With reference again to FIGS. 1 and 2, although sides 26 of the tongue and sides 20 of the groove are shown to be flat, it is understood that they may also be contoured, for example arched, as long as the sides suitably correspond with one another for forming a secure and releasably attachable tongue and groove joint. Groove bottom surface 28 and tongue top surface 22 likewise are shown as flat surfaces but they may also be contoured, such as arched.

Figure 3:
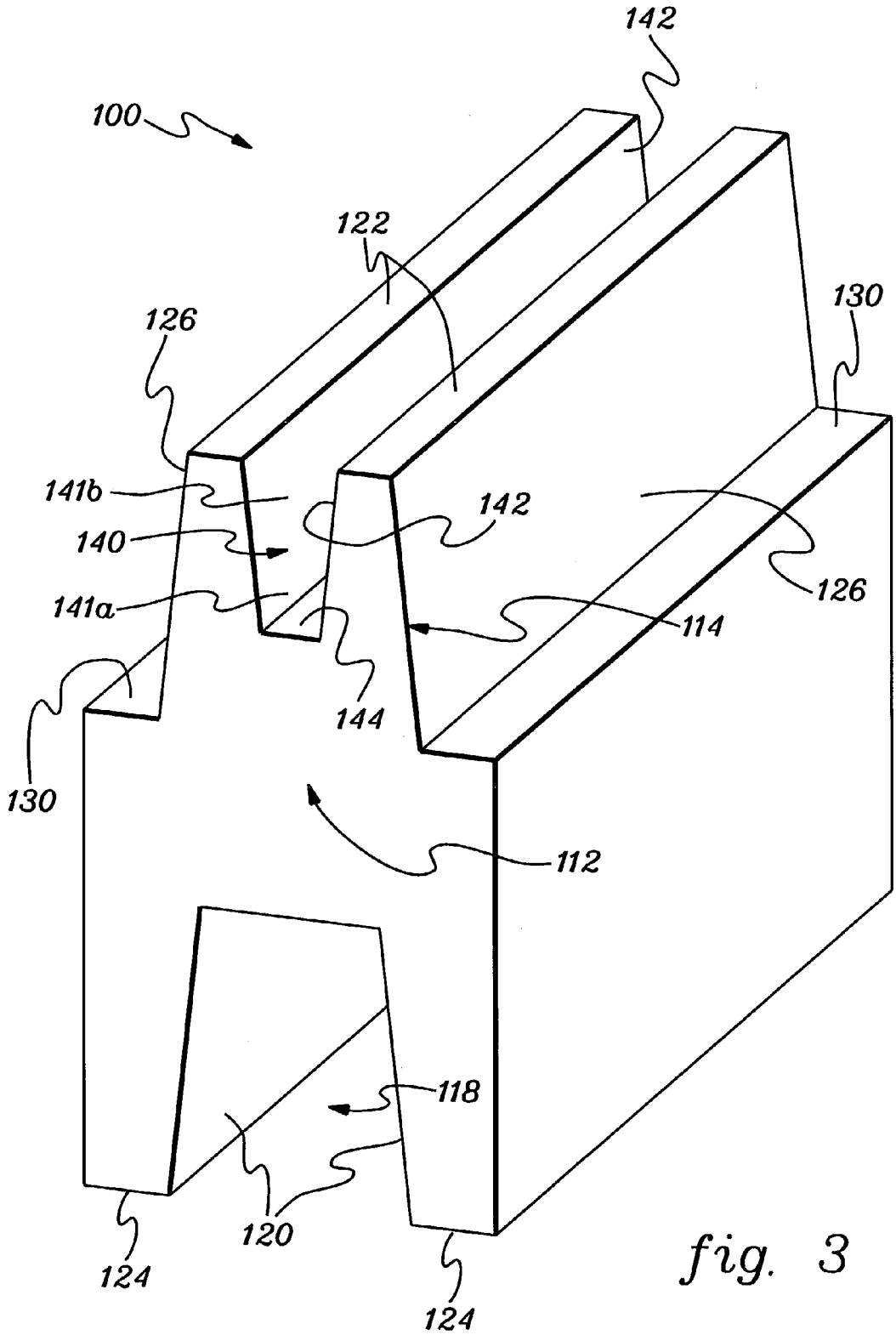
FIG. 3 is an isometric view of another building block in accordance with the present invention.
Figure 4:
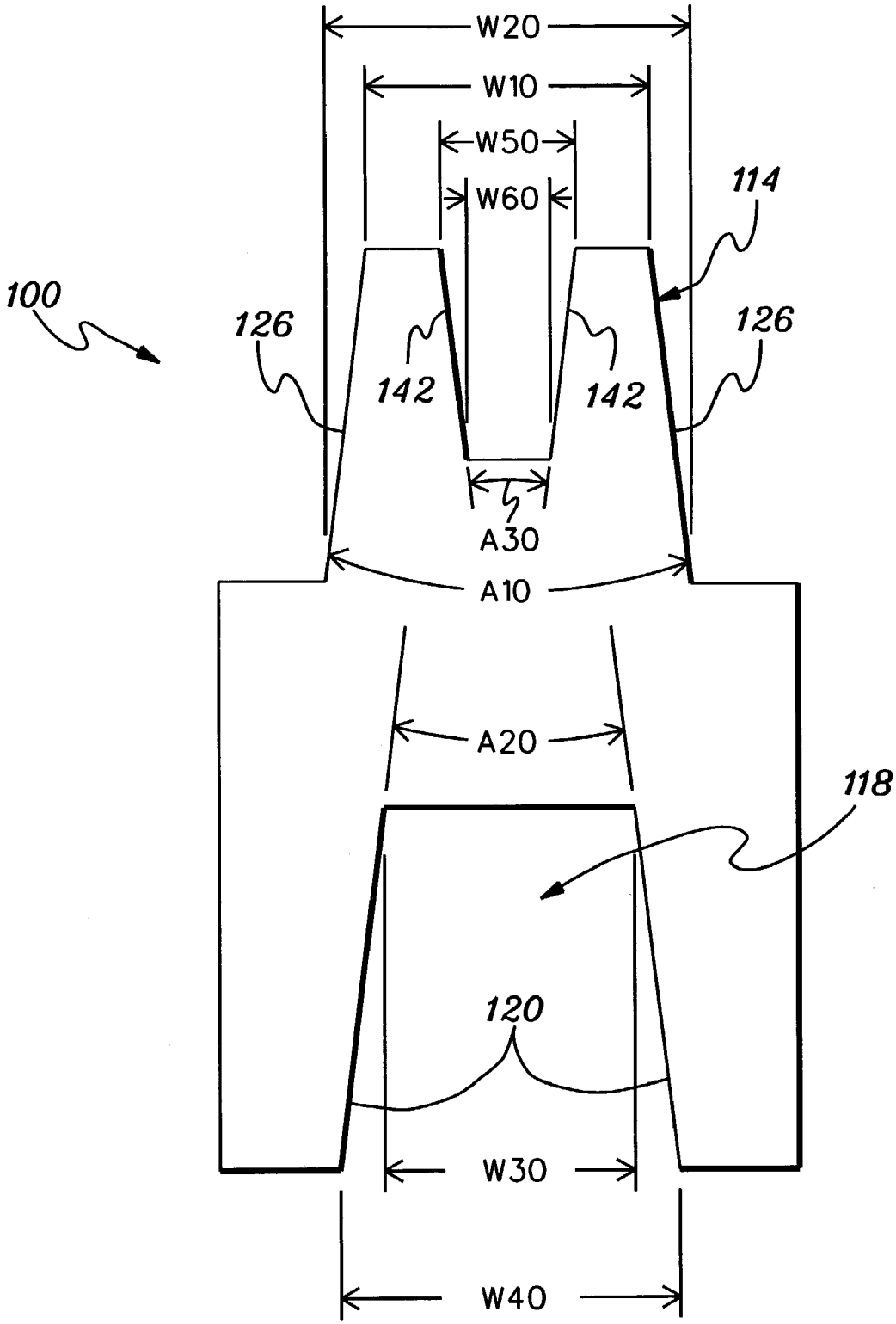
FIG. 4 is an end view of the block of FIG. 3.

FIGS. 3 and 4 illustrate a building block 100 in accordance with the present invention. The block has a body 112, a tapered tongue 114 having two sides 126, and two inner surfaces 120 forming a tapered first groove 118 therebetween. The tongue has two inner surfaces 142 forming a second groove 140 in the top of tongue 114. The second groove may have a bottom surface 144. Second groove 140 may run the length of tongue 114. The second groove has an opening with, for example a width W50 (FIG. 4), and a bottom portion with, for example a width W60 (FIG. 4), wherein W50 is wider than W60.

With further reference to FIG. 4, tongue 114 has a distal portion with, for example a width W10, and a proximal portion with, for example a width W20, wherein W20 is greater than W10. Groove 118 has a bottom portion with, for example a width W30, and an opening with, for example a width W40, wherein W40 is greater than W30. Groove opening width W40 is wider than a distal portion width W10 of the tongue. Distal portion width W10 of the tongue is wider than a bottom portion width W30 of the groove. Proximal portion width W20 of the tongue is wider than opening width W40 of the groove.

The second groove, as shown in FIG. 4, has its sides 142 converging toward each other at an angle A30 (FIG. 4). A30 may be the same as an angle of convergence (or angle of taper) A10 (FIG. 4) of the side 126 of the tongue and an angle of convergence A20 (FIG. 4) of the inner surfaces 120. The second groove, first groove, and tongue may be tapered symmetrically or asymmetrically. A first block 100 and a second block 100 are releasably attachable by inserting tongue 114 of the first block into the first groove 118 of the second block in a similar manner as described above in connection with building block 10.

Figure 1:
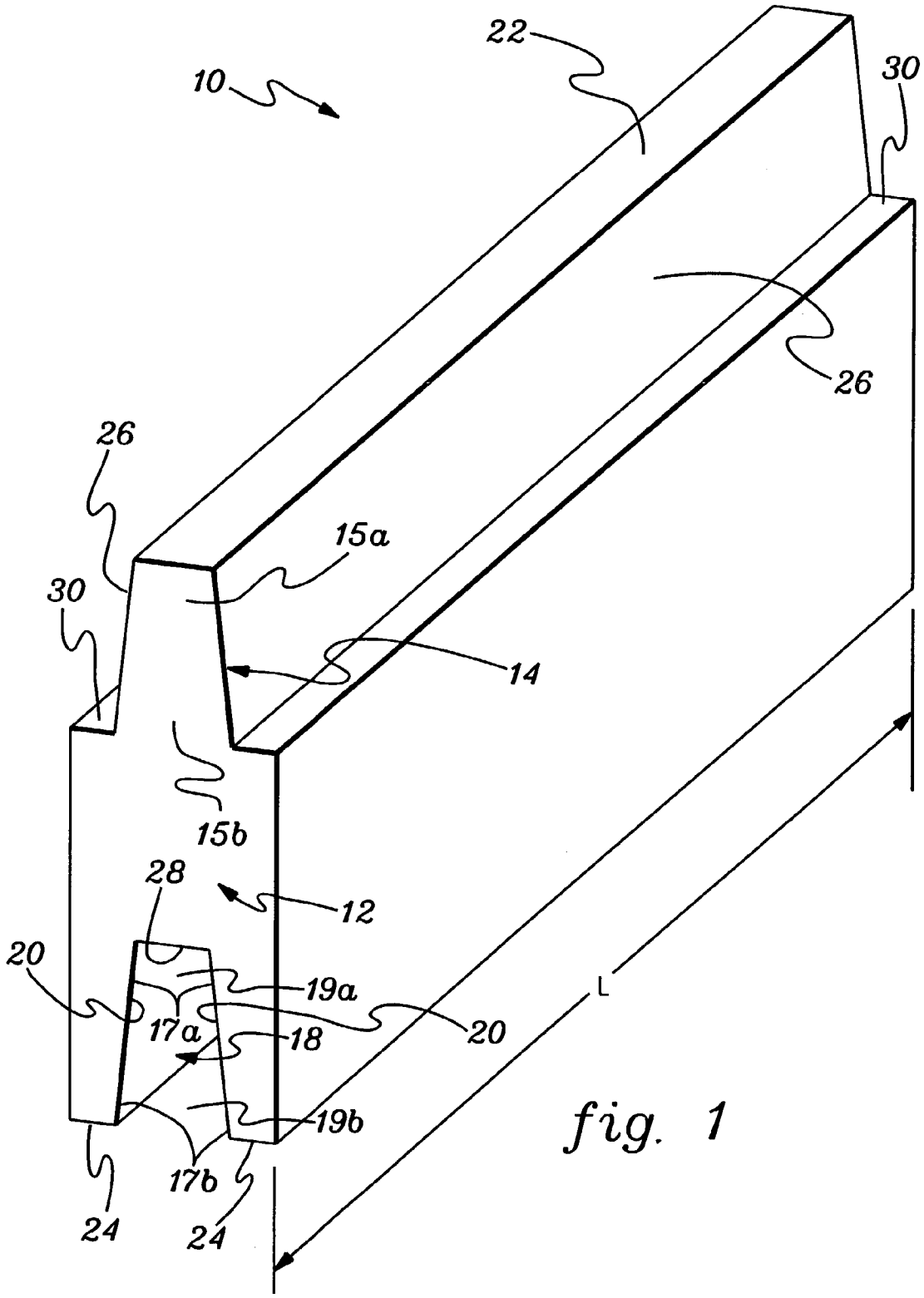
FIG. 1 is an isometric view of a building block in accordance with the present invention.
Figure 6A:
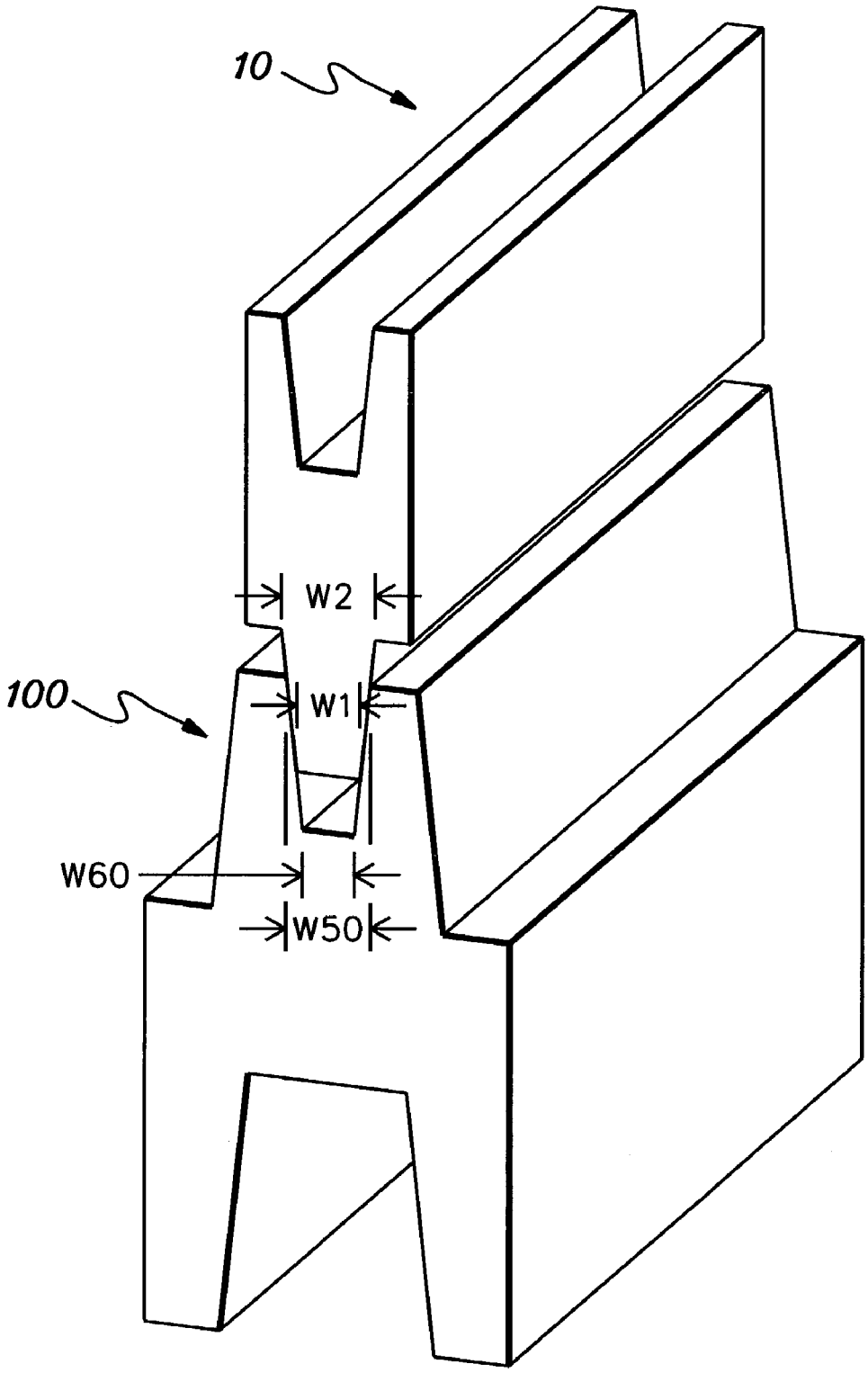
FIG. 6A is an isometric view of a block of FIG. 1 joined together with a block of FIG. 3.
Figure 6B:
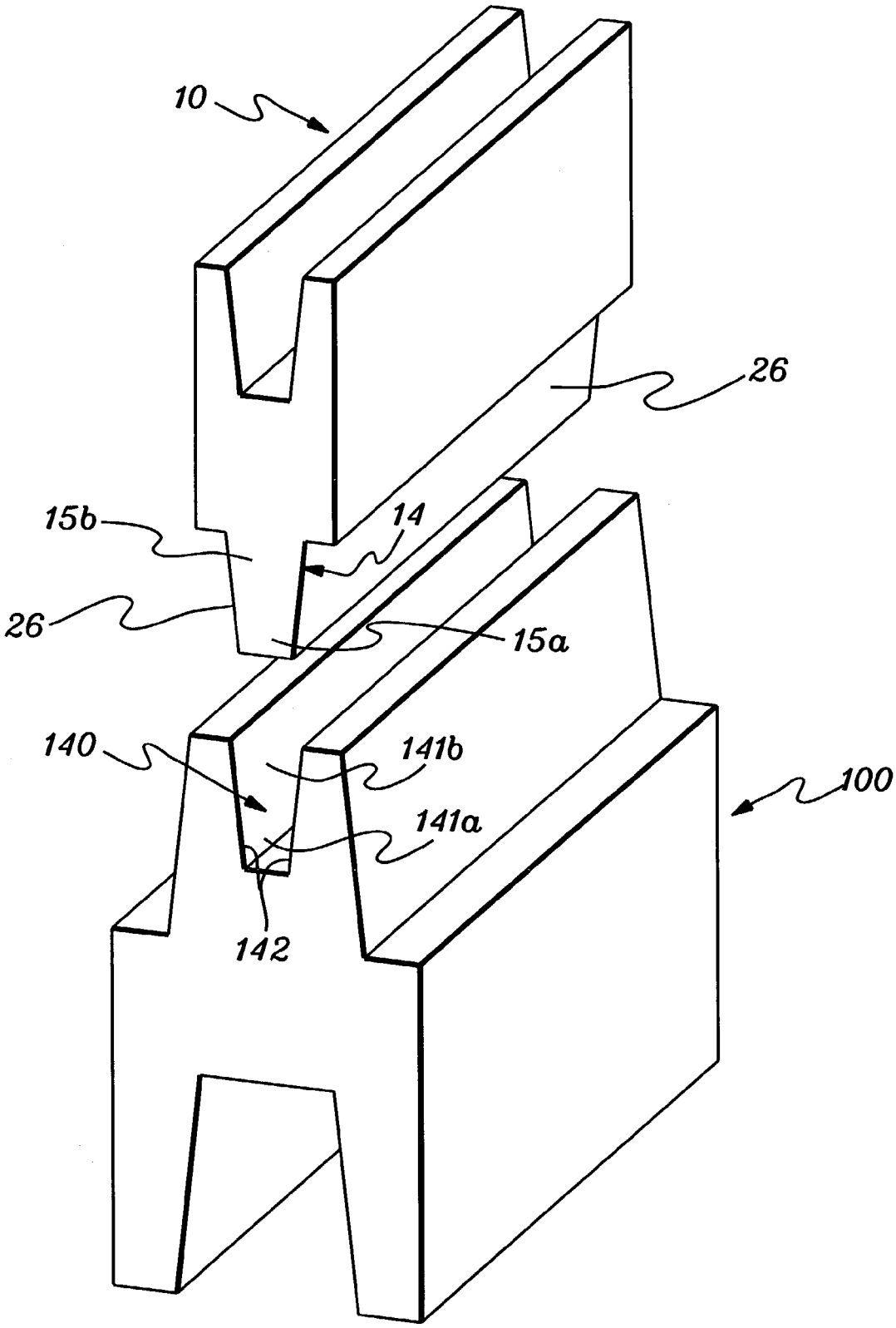
FIG. 6B is an exploded isometric view of the blocks of FIG. 6A.

As shown in FIGS. 6A and 6B, the first building block 10 of FIGS. 1 and 2, can be assembled with the second building block 100 of FIGS. 3 and 4, by inserting tongue 14 (FIG. 6B) of block 10 into second groove 140 (FIG. 6B) of block 100. The taper of second groove 140 may be substantially the same as the taper of tongue 14. Width W50 (FIG. 6A) of opening 141*b* (FIG. 6B) of second groove 140 is wider than width W1 (FIG. 6A) of distal portion 15*a* (FIG. 6B) of tongue 14. Width W1 of distal portion 15*a* of tongue 14 is wider than width W60 (FIG. 6A) of bottom portion 141*a* (FIG. 6B) of second groove 140. Width W2 (FIG. 6A) of proximal portion 15*b* (FIG. 6B) of tongue 14 is wider than width W50 of opening 141*b* of second groove 140.

With reference still to FIGS. 6A and 6B, although sides 142 (FIG. 6B) of second groove 140 of block 100 and sides 26 (FIG. 6B) of tongue 14 of block 10 are shown to be flat, it is understood that they may also be contoured, for example arched, as long as the sides suitably correspond with one another to form a secure and releasably attachable tongue and groove joint therewith.

Figure 7:
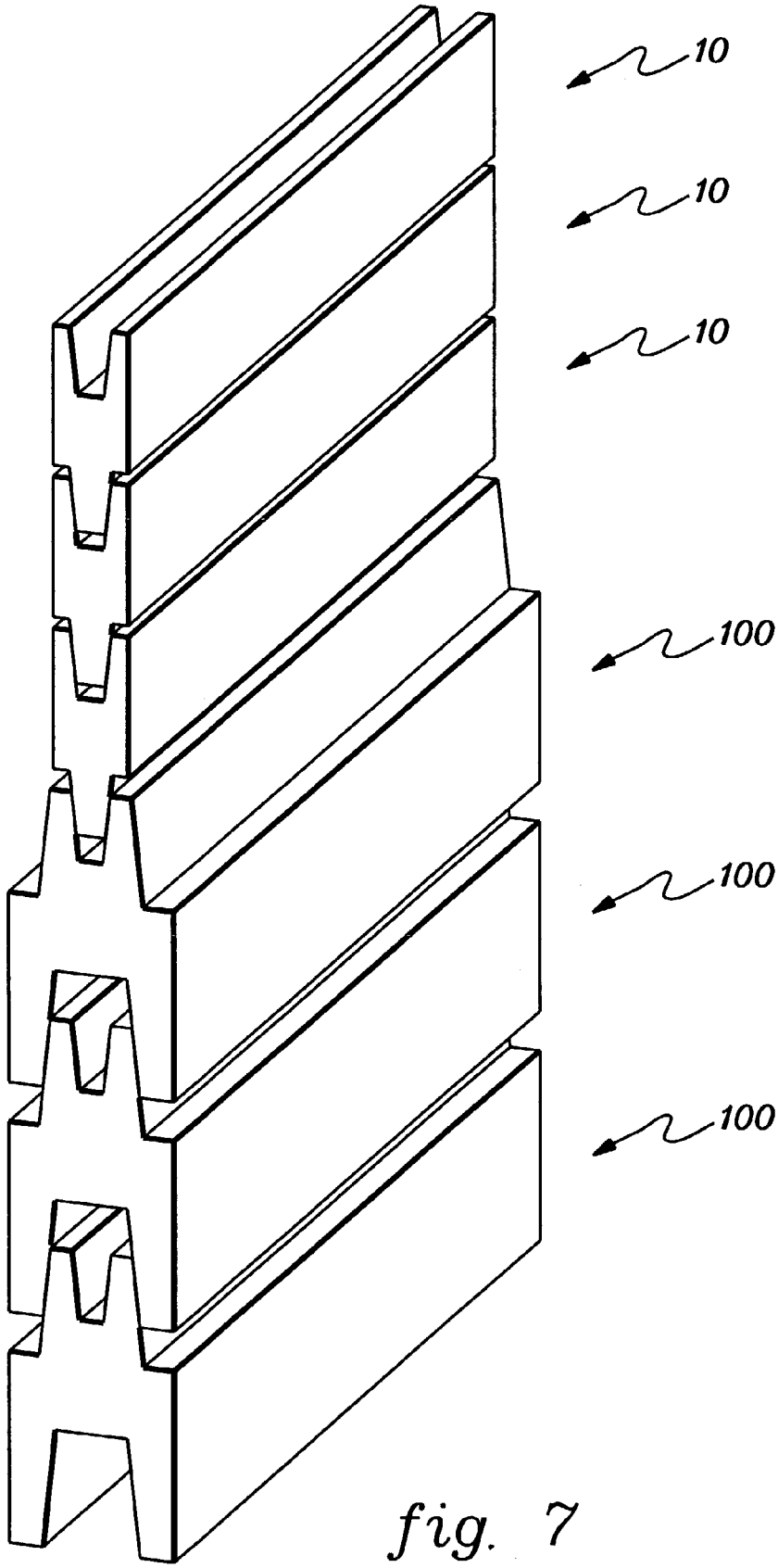
FIG. 7 is an isometric view of an assembly of six blocks including three blocks of FIG. 1 and three blocks of FIG. 3.

FIG. 7 shows an assembly of six blocks of the present invention, including three blocks 10 and three blocks 100.

Figure 8A:
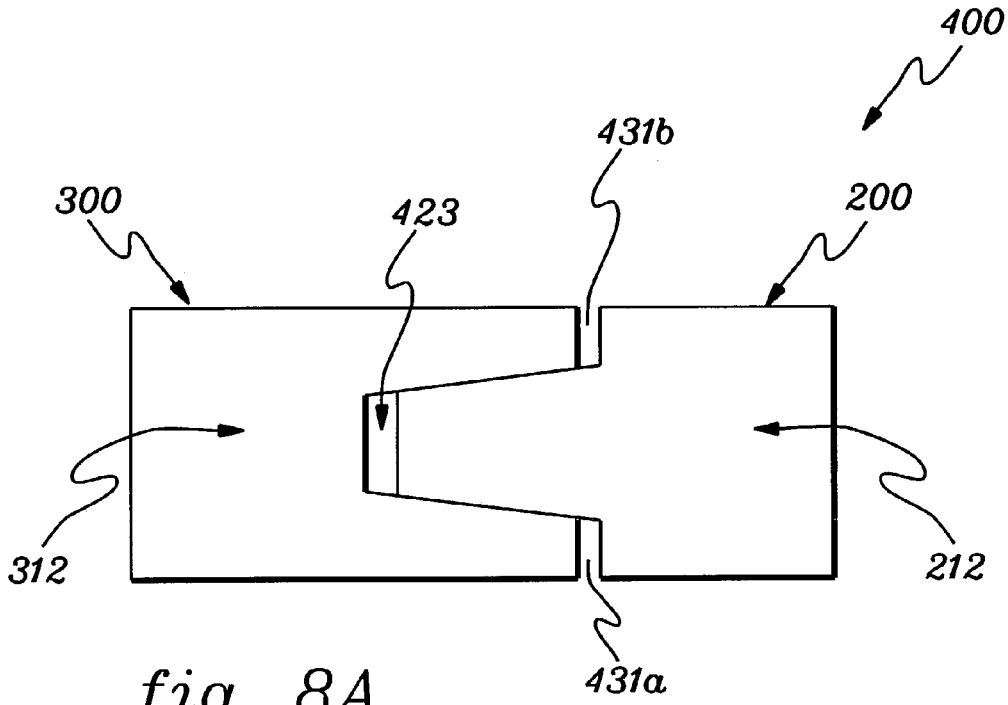
FIG. 8A is an end view of a tongue and groove joint in accordance with present invention.
Figure 8B:
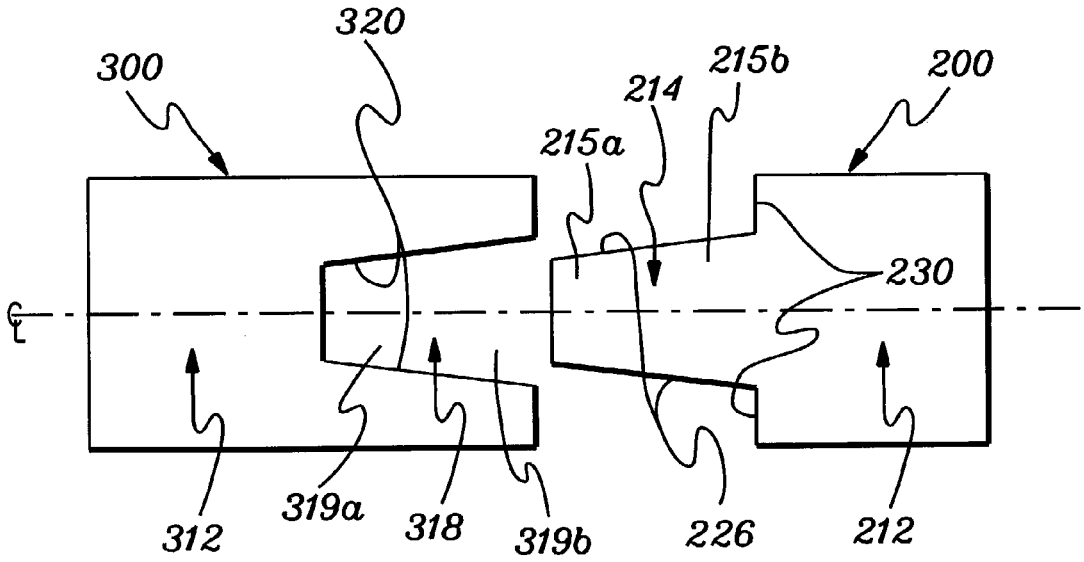
FIG. 8B is an exploded end view of the tongue and groove joint of FIG. 8A.

FIGS. 8A and 8B depict an end view of a tongue and groove joint 400 of the present invention. The joint comprises a tapered tongue 214 (FIG. 8B) of a first member 200 wedged into a tapered groove 318 (FIG. 8B) of a second member 300. The taper of the tongue and the taper of the groove may be substantially the same. The opening 319*b* (FIG. 8B) of the groove is wider than a distal portion 215*a* (FIG. 8B) of the tongue. The distal portion 215*a* of the tongue is wider than the bottom portion 319*a* (FIG. 8B) of the groove. The proximal portion 215*b* (FIG. 8B) of the tongue is wider than the opening 319*b* of the groove. Member 200 may have shoulders 230 on either side of the tongue.

When the tongue of member 200 is inserted into the groove of member 300, contact occurs between the sides 226 (FIG. 8B) of the tongue and the inner surfaces 320 (FIG. 8B) forming the groove. The body 212 of member 200 and the body 312 of member 300 may form gaps 431*a* (FIG. 8A) and 431*b* (FIG. 8A) therebetween. The distal end of the tongue and the bottom of the groove may form a gap 423 (FIG. 8A) therebetween. When the tongue is pressed into the groove, a tongue and groove joint 400 will form and releasably attach members 200 and 300 together. The blocks will be held together (e.g. horizontally as shown in FIG. 8A and along the length of the joint) by the compression and/or friction forces between the sides of the tongue and the inner surfaces forming the groove.

With still further reference to FIGS. 8A and 8B, the size of the gaps may be controlled to achieve certain desired effects as previously discussed above.

With still further reference to FIGS. 8A and 8B, although sides 320 of the groove and sides 226 of the tongue are shown to be flat, it is understood that they may also be contoured, for example arched, as long as they suitably correspond for forming a secure and releasably attachable tongue and groove joint therebetween.

FIG. 9 is an isometric view of a structure 500, such as a toy house, built on a base 550 in accordance with the present invention. The structure comprises a plurality of building blocks of the invention attached together by the tongue and groove means of the present invention. Some of the blocks in the building may comprise flat ends and others may comprise sloped or mitered ends, such as the blocks which form the peaked shape of the top of the building.

Figure 10:
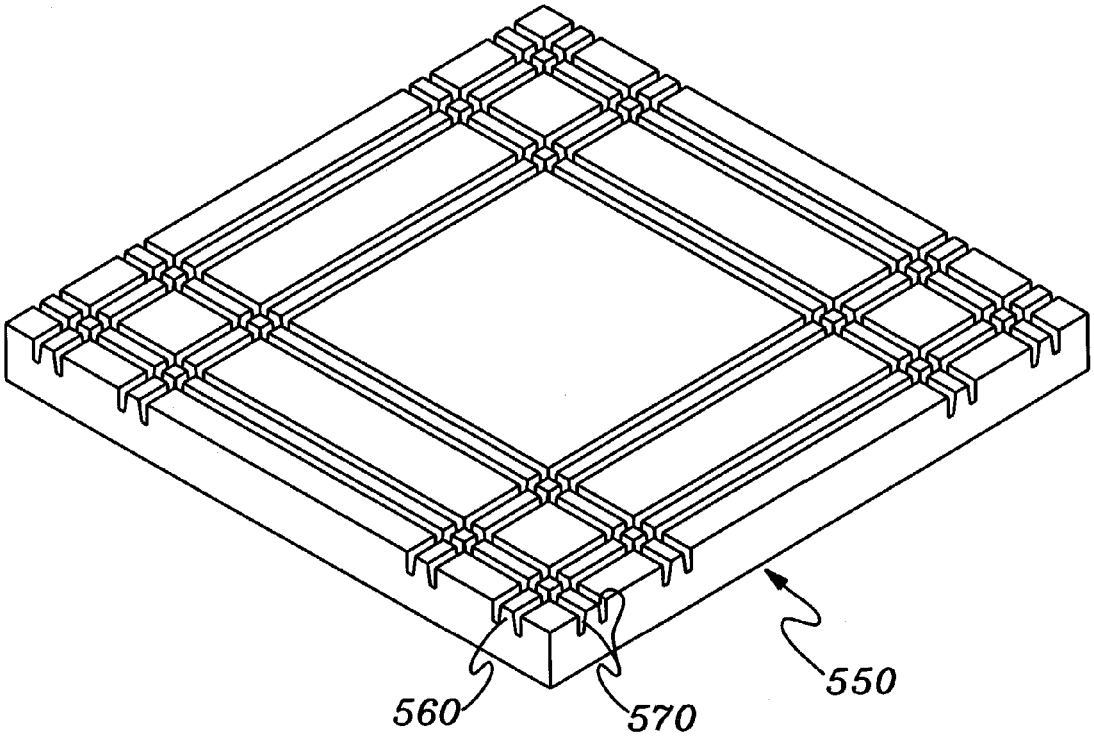
FIG. 10 is an isometric view of the base of FIG. 9.

Base 550 is best illustrated in FIG. 10. The base has a plurality of tongues 560 and grooves 570. The plurality of tongues and grooves are sized to form a releasably attachable tongue and groove joint of the present invention when assembled with the blocks of the present invention. The base may be double-sided, having a different pattern of tongues and grooves on each side. The pattern of tongues and grooves may be designed to provide the foundation for specific sized and shaped buildings, such as historic buildings. The base may also have multiple tiers or levels.

Figure 11:
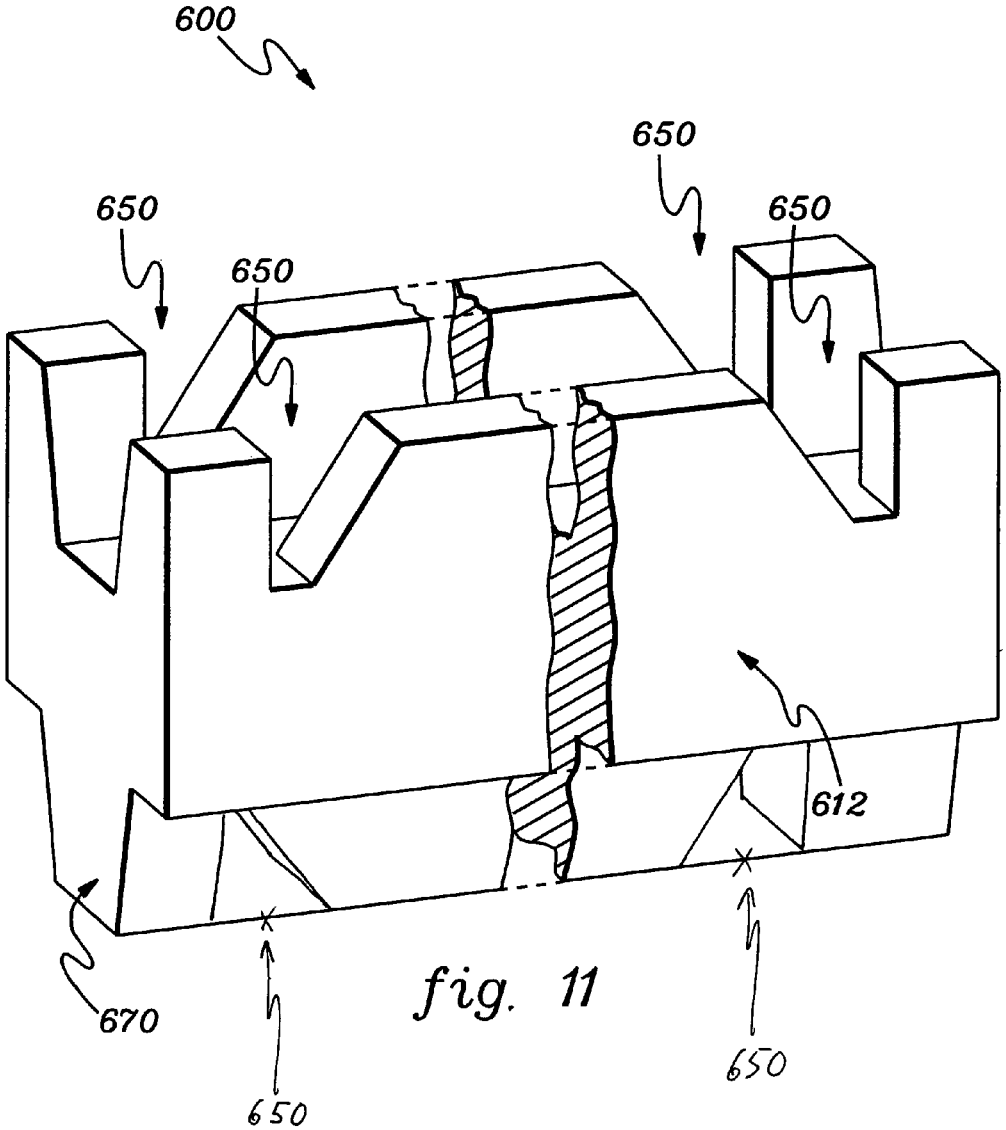
FIG. 11 is an isometric view of another building block having transverse notches in accordance with the present invention.

FIG. 11 is a broken isometric view of a block 600 having transverse notches 650 in accordance with the present invention. The transverse notches may be across the body 612 or across the tongue 670. The transverse notch facilitates the engagement of one block with blocks oriented perpendicularly thereto.

Figure 12:
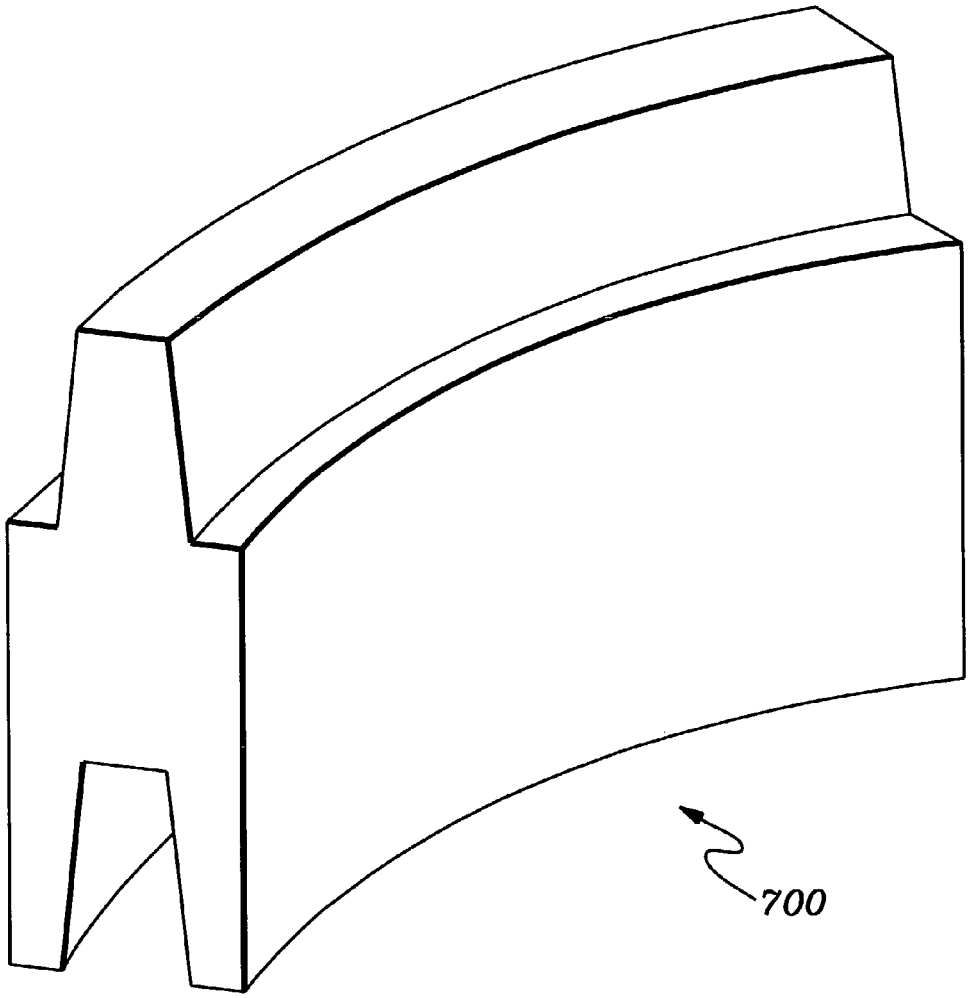
FIG. 12 is an isometric view of another building block having a curved configuration in accordance with the present invention.
Figure 13:
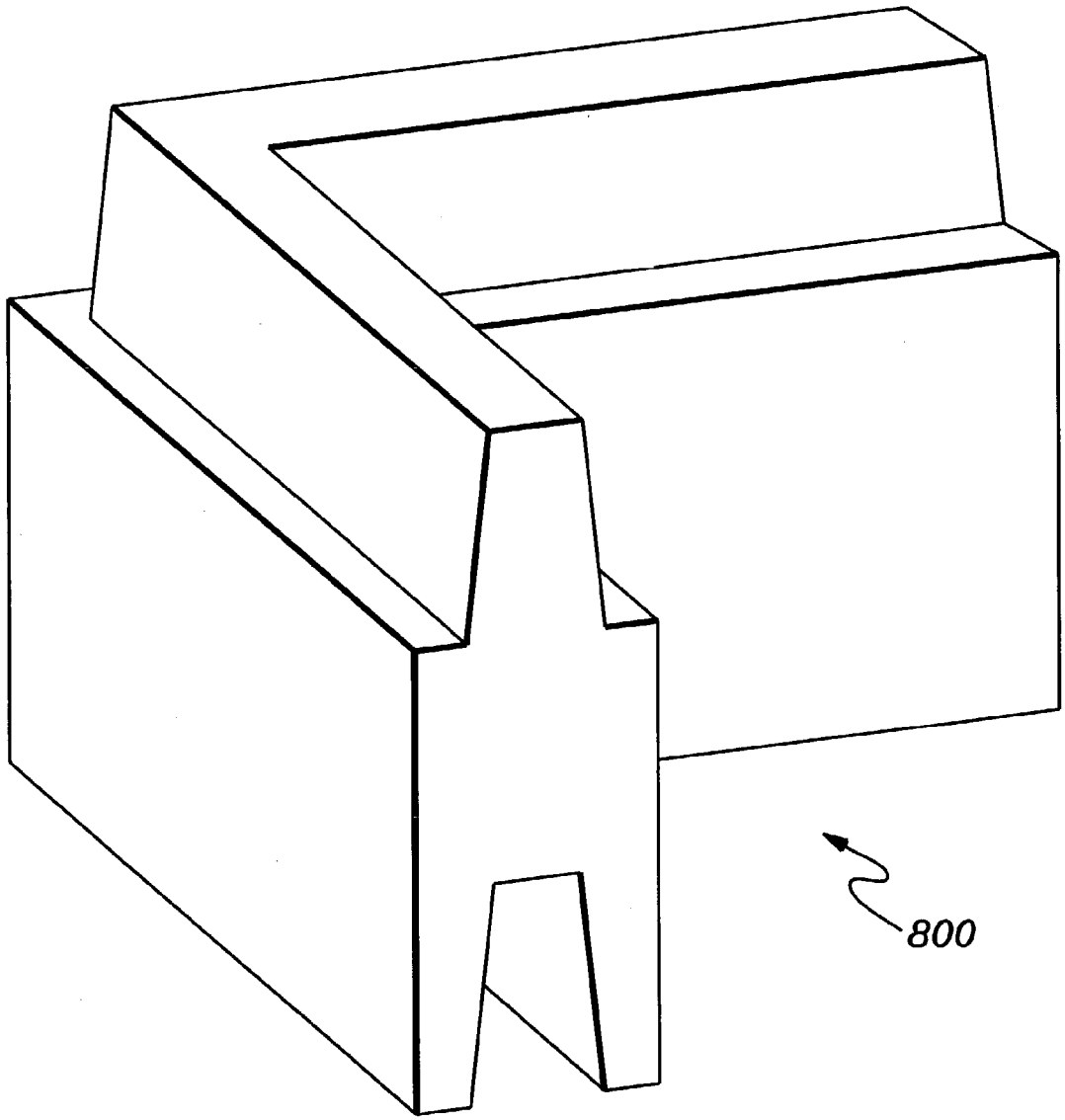
FIG. 13 is an isometric view of another building block having an angled configuration in accordance with the present invention.

FIGS. 12 and 13 illustrate blocks 700 and 800 of the present invention having curved and angled configurations along their lengths, respectively.

It is understood that the blocks of the present invention can be of any shape in the longitudinal direction. It is also understood that a block may have a plurality of tongues and grooves, for example, each face of the block may have a tongue or a groove.

Figure 14:
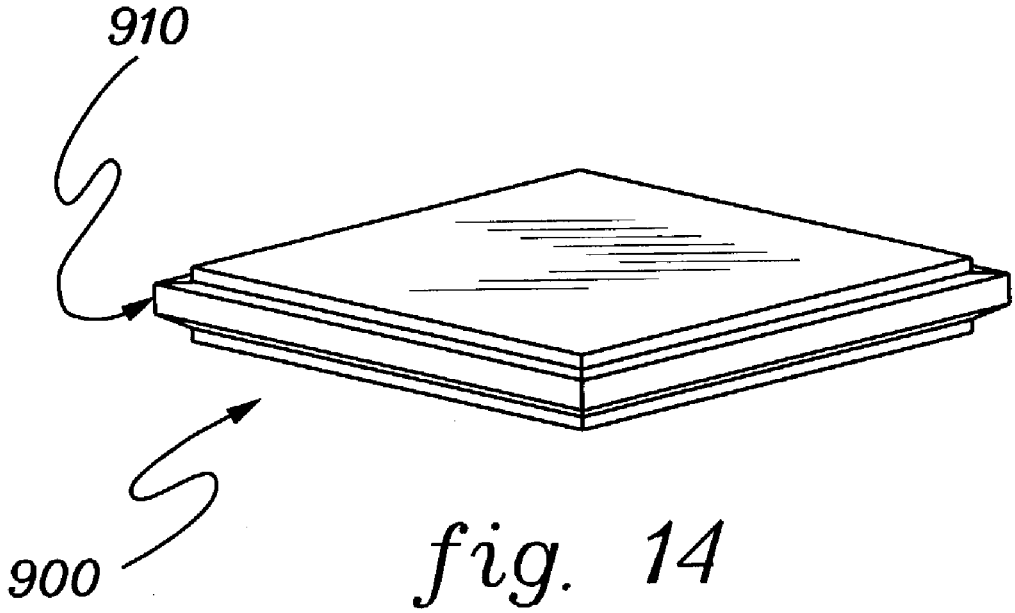
FIG. 14 is an isometric view of another building block having a tongue extending outwardly and around the block in accordance with the present invention.

FIG. 14 illustrates block 900 of the present invention having a tongue 910 extending outwardly and around the block.

Figure 15:
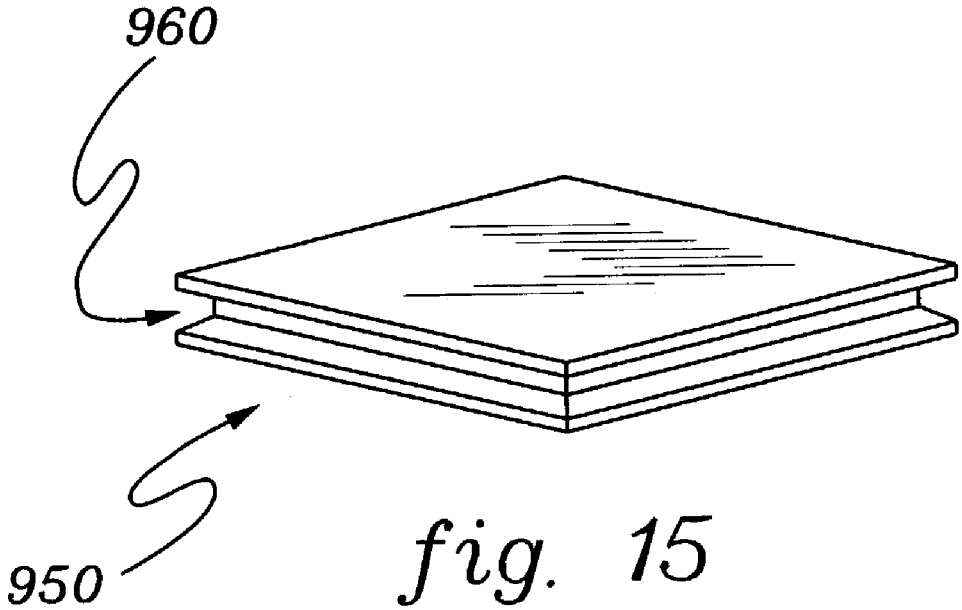
FIG. 15 is an isometric view of another building block having a groove extending around the block in accordance with the present invention.

FIG. 15 illustrates block 950 of the present invention having a groove 960 extending around the block.

While the invention has been particularly shown and described with reference to certain embodiments, it will be understood by those skilled in the art that various changes in form and details may be made to the invention without departing from the spirit and scope of the invention as described in the following claims.

What is claimed is:

1. A building block comprising:

a body;

a tapered tongue outwardly extending from said body;

said body having a tapered first groove; and wherein:

(a) the taper of said tongue and the taper of said first groove are substantially the same;

(b) an opening of said first groove is wider than a distal portion of said tongue;

(c) said distal portion of said tongue is wider than a bottom portion of said first groove; and (d) a proximal portion of said tongue extending outwardly from said body is wider than said opening of said first groove.

2. The block of claim 1 wherein a first side and a second side of said tongue are disposed at an angle of about 14 degrees relative to each other, and a first inner surface and a second inner surface of said body defining said first groove are disposed at an angle of about 14 degrees relative to each other.

3. The block of claim 1 wherein the block comprises wood.

4. The block of claim 1 wherein the block comprises plastic.

5. The block of claim 1 wherein a width of said block is less than about two inches and a height of said block is less than about two inches.

6. The block of claim 1 further comprising at least one transverse notch extending across said body.

7. The block of claim 1 further comprising at least one transverse notch extending across said tongue.

8. The block of claim 1 wherein said tongue further comprises a second groove.

9. The block of claim 8 wherein a first side and a second side of said tongue are disposed at an angle of about 14 degrees relative to each other, a first inner surface and a second inner surface of said body defining said first groove are disposed at an angle of about 14 degrees relative to each other, and a third inner surface and a fourth inner surface of said tongue defining said second groove are disposed at an angled of about 14 degrees relative to each other.

10. A building block kit comprising a plurality of building blocks of claim 1.

11. A building block kit comprising:

at least one of a first building block of claim 1; and at least one of a second building block comprising:

a body;

a tapered tongue outwardly extending from said body, said tapered tongue having a second groove;

said body having a tapered first groove; and wherein:

(a) the taper of said tongue and the taper of said first groove are substantially the same;

(b) an opening of said first groove is wider than a distal portion of said tongue;

(c) said distal portion of said tongue is wider than a bottom portion of said first groove; and (d) a proximal portion of said tongue is wider than said opening of said first groove; and wherein:

(a) the taper of said second groove and the taper of said tongue of said first block are substantially the same, (b) an opening of said second groove is wider than a distal portion of said tongue of said first block, (c) the distal portion of said tongue of said first block is wider than a bottom portion of said second groove; and (d) the proximal portion of the tongue of said first block is wider than an opening of said second groove.

12. The building block kit of claim 10 further comprising:

at least one second building block comprising:

a body having a tapered tongue outwardly extending therefrom, said tongue extending around said body; and wherein said second building block is releasably attachable to said first building block upon wedging the tongue of said second building block into the first groove of said first building block.

13. The building block kit of claim 10 further comprising:

at least one second building block comprising:

a body having a tapered first groove, said groove extending around said body; and wherein said second building block is releasably attachable to said first building block upon wedging the tongue of said first building block into the groove of said second building block.

14. The block of claim 1 wherein a first and a second of said building block are releasably attachable together at freely variable locations along the direction of the groove.

15. A building block comprising:

a body;

a tapered tongue outwardly extending from said body;

said body having a tapered first groove; and wherein a first and a second of said building block are releasably attachable together upon wedging the tongue of the first building block into the first groove of the second building block; and a top of the tongue of a first of said block and a bottom surface of the first groove of a second of said block form a gap therebetween when a first and a second of said block are releasably attached; and the body of a first of said block and the body of a second of said block form a gap therebetween when a first and a second of said block are releasably attached.

16. The block of claim 15 wherein a first side and a second side of said tongue are disposed at an angle of about 14 degrees relative to each other, and a first inner surface and a second inner surface of the body defining said first groove are disposed at an angle of about 14 degrees relative to each other.

17. The block of claim 15 wherein said tongue further comprises a tapered second groove.

18. The block of claim 17 wherein a first side and a second side of said tongue are disposed at an angle of about 14 degrees relative to each other, a first inner surface and a second inner surface of said body defining said first groove are disposed at an angle of about 14 degrees relative to each other, and a third inner surface and a fourth inner surface of said tongue defining said second groove are disposed at an angle of about 14 degrees relative to each other.

19. The block of claim 15 wherein a top of the tongue of a first of said block and a bottom surface of the first groove of a second of said block form a gap therebetween when a first and a second of said block are releasably attached.

20. A building block kit comprising a plurality of building blocks of claim 15.

21. A building block kit comprising:

at least one first building block of claim 15; and at least one second building block comprising:

a body;

a tapered tongue outwardly extending from said body, said tapered tongue having a second groove;

said body having a tapered first groove; and wherein said first building block and said second building block are releasably attachable together upon wedging said tongue of said first building block into said second groove of said second building block.

22. The building block kit of claim 21 wherein said tongue of said first building block and a bottom surface of said second groove of said second block form a gap therebetween when said first building block is releasably attached to said second building block.

23. The building block kit of claim 21 further comprising a base comprising a plurality of spaced-apart upwardly-extending tongues and a plurality of spaced-apart grooves, and wherein said base is releasably attachable to said first building block and to said second building block by inserting said tongue of said first building block and said tongue of said second building block into at least one of said plurality of grooves of said base and fitting said first groove of said first building block, said first groove of said second building block, and said second groove of said second building block over at least one of said plurality of tongues of said base.

24. A building block kit comprising:

at least one first building block of claim 15; and at least one second building block comprising:

a body having a tapered tongue outwardly extending therefrom; and wherein said first building block and said second building block are releasably attachable together upon wedging the tongue of said second building block into the groove of said first building block.

25. A building block kit comprising:

at least one first building block of claim 15; and at least one second building block comprising:

a body having a tapered groove; and wherein said first building block and said second building block are releasably attachable together upon wedging the tongue of said first building block into the groove of said second building block.

26. The block of claim 15 wherein a first and a second of said building block are releasably attachable together at freely variable locations along the direction of the groove upon wedging the tongue of the first building block into the first groove of the second building block.

* * * * *